United States Patent [19]

Rushworth

[11] 4,364,154

[45] Dec. 21, 1982

[54] FALLER BARS

[75] Inventor: Norman Rushworth, Shipley, England

[73] Assignee: Plastex (Bradford) Limited, Bradford, England

[21] Appl. No.: 204,468

[22] Filed: Nov. 6, 1980

[30] Foreign Application Priority Data

Sep. 26, 1980 [GB] United Kingdom ..... 8031073

[51] Int. Cl.[3] ..... D01G 5/14

[52] U.S. Cl. ..... 19/129 R

[58] Field of Search ..... 19/129 R

[56] References Cited

U.S. PATENT DOCUMENTS 899,280 9/1908 Young ..... 19/129 R 2,862,235 12/1958 Spisak ..... 19/129 R 3,694,858 10/1972 Isumi ..... 19/129 R

FOREIGN PATENT DOCUMENTS 1181599 2/1970 United Kingdom ..... 19/129 R

*Primary Examiner*—Louis Rimrodt

*Attorney, Agent, or Firm*—W. Thad Adams, III

[57] ABSTRACT

In order to overcome problems associated with the fitting of a pinned plastics strip into the bar of a faller bar, hot melt adhesive is applied to the strip before the strip is placed in the groove in the bar, and the adhesive is activated by heat derived from the bar. The bar may be already heated when the strip is fitted into the groove, although it could be heated after the strip has been placed in the groove.

3 Claims, 2 Drawing Figures

FALLER BARS

BACKGROUND TO THE INVENTION

Figure 1:
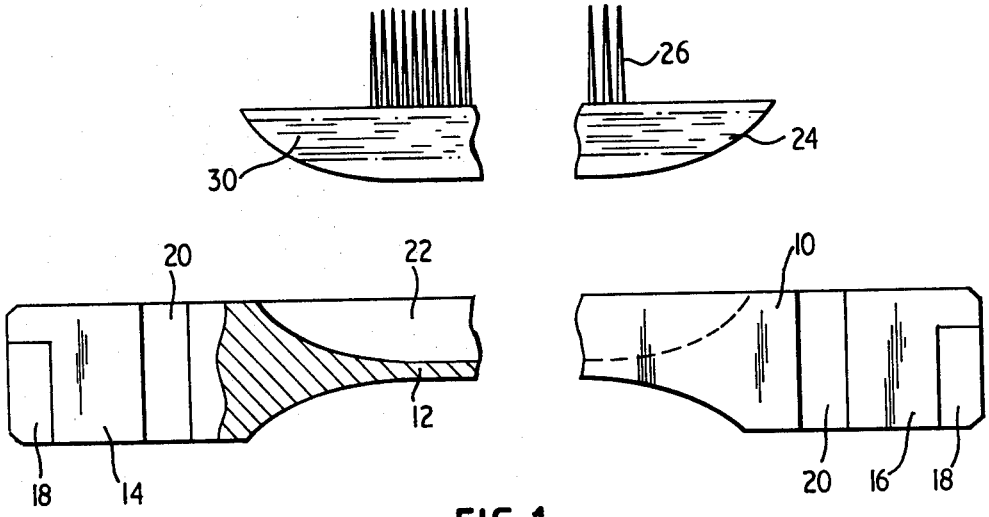

This invention relates to faller bars of the kind used in certain textile machines, for example gill boxes. Essentially, the conventional faller bar comprises a metal bar with a single row of pins upstanding from its top edge. The bar has a longitudinal translatory motion in a direction transverse to its own length during which its pins comb out the fibres of the sliver.

The traditional method of securing the pins in the bar body was to drill individual holes for the pins and then to force each pin into its respective hole. A later development was to solder the pins into a groove or slot formed in the bar. In recent years, it has become common to embed the roots of the pins in a preformed plastics strip which is subsequently fitted into a groove in the bar body, the plastics strip being secured in the body by an adhesive. This avoids the tedious drilling and soldering operations, since it is possible to grip all the pins in a jig, and to mould the plastics strip around the roots of the pins. The present invention is specifically concerned with a faller bar of the kind wherein the roots of the pins are anchored in a separate plastics strip, and for convenience, such a faller bar will be hereinafter referred to as a pin-strip type faller bar.

One of the problems associated with the manufacture of the pin-strip type faller bar is that of ensuring that on the one hand, the adhesive is effective, whilst on the other hand, the adhesive is not allowed to flow out of the groove into the spaces between the pins. At the present time, a hot melt adhesive is normally employed, and this is usually placed in the groove in the metal bar in the form of an extruded "rod" or in the form of solid chips. In either case, heat is applied to the bar to cause the adhesive to become molten in the groove, and then the plastics strip is pressed into the groove, causing the adhesive to flow up both flanks of the strip. It will be appreciated, that it is very difficult to ensure that there is not an excess of adhesive at some points along the length of the bar, and it is the primary object of the present invention, to provide a method of manufacturing a pin-strip type faller bar, which overcomes the aforementioned problem.

GENERAL FEATURES OF THE INVENTION

According to this invention a method of manufacturing a pin-strip type faller bar comprises the steps of: applying a heat-activated adhesive in molten condition to the pinned plastics strip; placing the strip in the groove in the bar and activating the adhesive by heat derived from the bar. Preferably a thin layer (for example in the order of a few thousandths of an inch thick) of the adhesive is applied to the strip. It is preferred that the layer of adhesive is not more than 0.010 inches thick. The adhesive is preferably applied to one or both flanks of the strip.

According to a preferred method, the adhesive is a low temperature hot melt adhesive which is heated sufficiently to melt it before it is applied to the strip. Such an adhesive solidifies quickly and it is preferred to allow it to solidify before the strip is fitted into the groove in the bar as this facilitates handling of the strip. It will be appreciated, that when a very thin layer of the low temperature melt adhesive is applied to one or both flanks of the plastics strip and then allowed to solidify, there is no problem in handling the strip, because its surfaces are non-tacky. Moreover, the strip can readily be pressed into the groove in the faller bar, and at that stage, the adhesive is still solid. When heat is applied to the faller bar (or if the bar is already heated when the strip is fitted) sufficient to melt the thin layers of adhesive, because those layers are then tightly sandwiched between the flanks of the strip and the inside faces of the groove in the faller bar, there is virtually no flow of the adhesive, and certainly there is no problem of excess adhesive flowing out of the bar. As soon as the bar cools, the adhesive sets, and bonds the strip to the bar.

An incidental advantage of the method according to the invention, is that when it is required to remove the pinned strip, it is only necessary to apply heat to the faller bar sufficient to melt the adhesive, and the strip can then be removed, leaving so little adhesive within the groove of the faller bar, that it can be ignored in the fitting of a further strip. This is a real advantage, because with the heretofore exercised methods of adhesion, there has always been a considerable residue of adhesive left in the groove, and it has been necessary to attempt to clean this out of the bar before a fresh pinned strip could be fitted. Furthermore if the replacement pinned strip is fitted whilst the bar is still warm enough to melt the adhesive on the strip, no further heating is required.

The invention also includes faller bars constructed by the method herein described.

SPECIFIC EMBODIMENT

Figure 2:
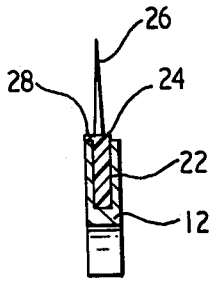

A method of manufacturing a pin-strip type faller bar in accordance with the invention, will now be described by way of example only, with reference to the accompanying drawings, in which:

FIG. 1 is a partly sectioned "exploded" elevation showing a stage in the manufacture of the faller bar, and FIG. 2 is a cross-section through the finished faller bar.

The faller bar has a steel body 10 of conventional construction. Essentially, this bar comprises a long central portion 12 of rectangular cross-section, and end portions 14 and 16. The latter are formed with inclined faces 18 for engagement by the screws which cause the bar to be traversed through the combing machine, and with grooves 20, whereby the bar is located in the machine. It is not necessary to describe the ends of the faller bar in detail, as these are conventional and do not form part of the invention.

The central portion 12 of the bar body is formed with a relatively deep groove 22, to receive a plastics strip 24, the shape of which is complementary to that of the groove 22.

The strip 24 is moulded in a jig (not shown) around the roots of a row of pins 26, which form the effective combing pins of the faller bar when the strip 24 is fitted into the groove 22. As illustrated in FIG. 2, the strip has a lip 28 along one edge to locate on one of the top edges of the central portion 12 of the bar body, though this is not essential, and in some cases, the bar will locate in the bottom of the groove 22. The method of manufacturing the pinned bar 24 need not be described in detail, since this can now be regarded as conventional. In a particular example, the bar may be made of nylon.

A thin layer 30 of adhesive is applied to each of the flanks of the bar 24. As illustrated in FIG. 1, this layer of adhesive perferably terminates below the top and above the bottom edges of the strip, so that it does not cover the entire flank of the strip. At the same time, it is important that the layer of adhesive should cover a substantial proportion of the flank of the strip.

The adhesive used is a low temperature melt adhesive, which is applied through an applicator, which includes a heater. The adhesive is supplied to the applicator in solid form, but is melted before it is applied to the flanks of the strip 24. The applicator is adjusted, so that each adhesive layer is only a few thousandths of an inch thick. In a typical example, the layer may be 0.003 inches thick. Because the adhesive sets very quickly in normal atmospheric conditions, and particularly because the layer of adhesive is only a thin film, it solidifies almost immediately on application to the plastics strip. Hence, the pinned strip 24 can be readily manipulated as soon as it has been coated.

The strip 24 is pressed into the groove 22 in the faller bar body in the normal manner, and then sufficient heat is applied to the faller bar, to activate the adhesive. When the bar is allowed to cool again, the pinned strip 24 becomes bonded in the body 10, and the faller bar is then ready for use. It will be appreciated, that the temperatures used to melt the adhesive, both in the applicator, and in the faller bar body, are so low that they have no effect on the plastics strip itself.

When it is required to replace the pinned strip because the pins have become broken or worn, it is only necessary to apply sufficient heat to the faller bar body to melt the adhesive, and the strip 24 can then be pulled out. As previously mentioned, the quantity of adhesive left in the groove is so small, that there is no necessity to attempt to clean it out before inserting a further pinned strip. If the fresh strip is inserted quickly enough no further hearing is required as the bar will be warm enough to activate the adhesive on the fresh strip.

I claim:

1. A method of manufacturing a pinned strip-type faller bar comprising the steps of:

(a) applying a hot melt adhesive in molten condition to at least one of the flanks of a pinned plastic strip, the adhesive having a low melting temperature such that in its molten condition the adhesive will not damage the plastic strip;

(b) allowing the adhesive to solidify on the pinned plastic strip;

(c) heating the faller bar;

(d) placing said pinned plastic strip in the groove in said faller bar;

(e) activating the adhesive by heat derived from said faller bar to cause the strip to adhere thereto.

2. A method of manufacturing a pinned strip-type faller bar according to claim 1, wherein the adhesive is applied to the strip in a layer not greater than 0.010 inches thick.

3. A pinned plastic strip for use in a grooved pinned strip-type faller bar, comprising an elongate plastic strip of rectangular cross-section, the depth of the strip being greater than its width, and adapted to be received in an elongate slot formed in a faller bar body, there being a plurality of metal pins arranged in at least one longitudinal row, the roots of said pins being embedded in said plastic strip and the pointed ends thereof projecting from said plastic strip, said pinned plastic strip having a solidified heat-activated adhesive layer applied to at least one of its flanks, whereby said pinned plastic strip can be secured in the groove of the faller bar by heat-activation of said adhesive layer.

* * * * *